US009911293B2

(12) United States Patent
Lee

(10) Patent No.: US 9,911,293 B2
(45) Date of Patent: Mar. 6, 2018

(54) SECURITY DEVICE FOR INTEGRATION INTO A SECURITY SYSTEM

(71) Applicant: Jonathan Lee, Warner Robins, GA (US)

(72) Inventor: Jonathan Lee, Warner Robins, GA (US)

( * ) Notice: Subject to any disclaimer, the term of this patent is extended or adjusted under 35 U.S.C. 154(b) by 0 days.

(21) Appl. No.: 14/594,553

(22) Filed: Jan. 12, 2015

(65) Prior Publication Data

US 2016/0203687 A1 Jul. 14, 2016

(51) Int. Cl.
*G08B 13/08* (2006.01)
*G08B 25/10* (2006.01)

(52) U.S. Cl.
CPC ..... *G08B 13/08* (2013.01); *G08B 25/10* (2013.01)

(58) Field of Classification Search
CPC ..... G08B 13/00; G08B 13/06; G08B 13/08; G08B 13/22; G08B 13/126; G08B 13/122; G08B 13/149; G08B 25/008; G08B 25/10; E05B 45/06
USPC ..... 340/541, 542, 545.1, 545.2, 546, 545.6, 340/550
See application file for complete search history.

(56) References Cited

U.S. PATENT DOCUMENTS 5,710,987 A * 1/1998 Paulick ..... H01Q 1/242 343/702
5,714,933 A 2/1998 Le Van Suu
6,131,428 A * 10/2000 Wildman ..... E05B 37/08 70/301
6,184,846 B1 * 2/2001 Myers ..... G07F 13/025 141/351
7,019,615 B2 3/2006 Denison
7,741,952 B2 6/2010 Denison
89,026,816 9/2011 Chao Cheng
8,633,829 B2 1/2014 Cavanaugh
2004/0066275 A1 * 4/2004 Mickler ..... F41C 33/06 340/5.33
2004/0205936 A1 * 10/2004 Denys ..... E05B 15/02 16/412
2006/0097949 A1 * 5/2006 Luebke ..... H01Q 1/40 343/873

(Continued)

FOREIGN PATENT DOCUMENTS

EP 0848130 6/1998
EP 1067496 10/2001

(Continued)

OTHER PUBLICATIONS

PCT/US2016/12800 Inernational Search Report and Written Opinion.

*Primary Examiner* — Laura Nguyen
(74) *Attorney, Agent, or Firm* — Mehrman Law Office; Michael J. Mehrman

(57) ABSTRACT

This invention relates to an apparatus and retrofit method for integrating a safe into a security system, said apparatus comprising a wireless transmitter that transmits the condition of the safe to the receiver of a security system. The apparatus comprises at least one battery-operated transmitter in wireless communication with at least one receiver through an antenna concealed on the exterior surface of the safe and sensors connected to the transmitter. The design of the safe body and the integration with a wireless interface allows for flexibility and portability of the safe while maintaining strong security.

18 Claims, 5 Drawing Sheets

(56) References Cited

U.S. PATENT DOCUMENTS

2008/0223930 A1* 9/2008 Rolland ..... G06Q 10/087 235/385
2009/0056390 A1 3/2009 Falkenson
2009/0126427 A1* 5/2009 Pallo ..... E05B 13/103 70/332
2009/0165682 A1* 7/2009 Cleveland ..... G06F 21/86 109/23
2009/0243859 A1* 10/2009 Bergman ..... G06K 7/10316 340/572.7
2010/0271808 A1* 10/2010 Gammell ..... E05B 17/10 362/100
2011/0114625 A1* 5/2011 Chung ..... A47J 39/006 219/385
2012/0068894 A1* 3/2012 Feldstein ..... H01Q 1/007 343/702
2012/0299755 A1* 11/2012 Jones ..... G08B 13/1436 340/990
2013/0067969 A1* 3/2013 Webb ..... E05B 47/00 70/78
2013/0241694 A1* 9/2013 Sharma ..... G08C 17/02 340/5.64
2014/0027507 A1 1/2014 Jonely
2014/0062466 A1* 3/2014 Thibault ..... G01B 7/14 324/207.22
2014/0292194 A1* 10/2014 Sagal ..... F21K 9/1355 315/34
2014/0292447 A1* 10/2014 Kawamura ..... H01P 5/02 333/208
2014/0340266 A1* 11/2014 Lin ..... H01Q 1/243 343/702
2014/0353543 A1 12/2014 Wu et al.
2015/0332527 A1 11/2015 Pukari
2016/0232762 A1* 8/2016 Westman ..... G08B 13/1895

FOREIGN PATENT DOCUMENTS

EP 2091924 A2 8/2009
JP 5-25973 2/1993
JP 6-32666 4/1994
KR 10-2011-0120180 11/2011
WO 1995027959 10/1995
WO 2005022477 3/2005

* cited by examiner

SECURITY DEVICE FOR INTEGRATION INTO A SECURITY SYSTEM

BACKGROUND OF THE INVENTION

Conventional safes are generally of a stand-alone type that can perform only the functions set by the hardware and software originally equipped through the manufacturing process. This makes it impossible to expand the functions of the safe unless the safe itself is replaced as a whole, even if the user wishes to enjoy additional functions such as integration into a home or small business security system. While a number of different types of safe security systems have been designed or proposed which include a central system and a remote sensor installed on the safe and designed to respond to an intruder, the great majority of such systems are designed to be permanently installed with the central system permanently wired to the safe sensor.

Although some devices are available to integrate safes with security systems, they have generally met with limited success and share numerous weaknesses. For example, a problem that often arises with hard-wired after-market solutions is the prohibitive modification costs associated with embedding a sensor and related infrastructure for use in connection with an existing safe. Even if the owner is willing to pay these costs, modification such as this is sometimes not allowed in rental situations or may be prevented by the configuration or location of the safe within the home, business, or bank.

Additionally, it is desirable to hide the location of any sensors, as well as their connection to the central security system, to prevent a thief from discerning their location and defeating their operation. Unfortunately, installation of the prior art devices generally require installers to run new wiring. Extra wiring is a telltale sign to thieves that a security system is being employed to protect a safe. The extra wiring also provides a weak link in the alarm system by giving away the location of the sensor which is easily disabled by cutting the wires that connect to the central security system.

In order for a safe integration device to avoid these deficiencies it must be wireless with an antenna capable of communicating wirelessly with a central security system. If a smaller antenna is used with the existing lock assembly and cavity, the efficiency of the antenna's electromagnetic (EM) radiation will not be optimal. It is possible to create, such as with a router or other means, a larger cavity within the body of the safe so that a much larger antenna can be placed within the door in conjunction with the lock assembly, but commercial safes are almost universally made of strong metal, so retrofitting them can be costly. In addition, an antenna contained within a safe door's cavity, regardless of whether the cavity has been enlarged or not, has to penetrate the door's material which is acting as a barrier to efficient EM radiation. In light of this, on a standard metal safe, an external antenna is required for optimal performance.

Therefore, what is needed is a safe that integrates an unobtrusive antenna, made of a signal-conducive material and enclosed in a protective covering, into the external door construction such that the antenna sends a strong wireless signal and is hidden from obvious sight thus enabling an owner to easily integrate a safe into a central security system when desired and therefore add security functionality without any significant invasive, time consuming, and/or expensive modification to the safe or the building.

BRIEF SUMMARY OF THE INVENTION

Accordingly, among the several objects of this invention may be noted the provision of an apparatus for, as described and shown herein, a security device that integrates with a home security system, thus making it possible to change or expand the functions of an existing storage container, such as a safe. The basic apparatus is an easy-to-retrofit kit allowing for installing of the security device on a standard home safe with minimal modification to the safe body. In an alternate embodiment, the security device of the present invention may be incorporated into a safe during the original construction of the safe. The portability of the resulting safe, achieved through a wireless connection and, if desired, a smaller size of safe, allows for flexibility of safe placement within the home or business.

Generally described, without restriction on the scope of the invention as contained in the appended claims, one preferred embodiment of the wireless alarm interface comprises a safe with at least one battery-operated transmitter in wireless communication with at least one receiver and at least one sensor connected to the transmitter. The battery is optimally selected to be long lasting, preferably functioning for at least five (5) years before requiring replacement. The security system is configured to alert the owner of a low battery status. The wireless communication is achieved through wireless signals. The receiver is connected to or otherwise integrated with a security system.

The apparatus of the present invention is suited for incorporation into a safe during the original manufacturing process as well as through an after-market, retrofit installation. For example, according to one aspect, the safe can be manufactured with an embedded antenna. Alternatively, the retrofit method comprises incorporating one or more external channels into a base plate installed under the safe's lock face on a door of the safe, where each channel is sized to retain at least a portion of the antenna, and inserting at least a portion of the antenna within the one or more channels; connecting the antenna to the secure device and connecting one or more sensors to the security device. This method inserts the antenna wire into the safe through a pre-existing entry created for the lock wire during the safe's original manufacture or, if necessary, an entry formed as part of the after-market modification. In another embodiment, the retrofit method comprises incorporating one or more portals or openings through the safe door under the safe's lock face on a door of the safe, where each portal or opening is sized to retain the wiring from the antenna to the connection to the contacts inside the safe; connecting the antenna to the secure device (i.e., the transmitter) and connecting one or more switches to the security device. This method inserts the antenna wire into the safe through a pre-existing entry created for the lock wire during the safe's original manufacture or, if necessary, an entry formed as part of the after-market modification.

Different users have different applications and requirements for how the safe will integrate and function. Therefore, this apparatus is customizable through the inclusion of various additional sensors depending on each owners individual needs. One or more sensors can then be used to communicate to the central security system through the universal safe interface device. Examples of such sensors include switches, passive infrared detectors, ultrasonic detectors, microwave detectors, photo-electric beams, vibration or inertia sensors, passive magnetic field detection, and microphonic systems. One implementation of the invention provides for a security system response when merely unlocking than safe, rather than requiring a special security code or hidden bypass to triggered the alarm system. This is advantageous when accessing the safe under duress and not wishing to alert an intruder that an alarm has been trigged. Another implementation of the invention provides an apparatus for causing a security system to respond to the horizontal or vertical movement of the safe through an embedded sensor or through movement of the safe out of the wireless range of the security system.

BRIEF DESCRIPTION OF THE DRAWINGS

The particular features and advantages of the invention as well as other objects will become apparent from the following description taken in connection with the accompanying drawings in which.

DETAILED DESCRIPTION OF THE INVENTION

Figure 1:
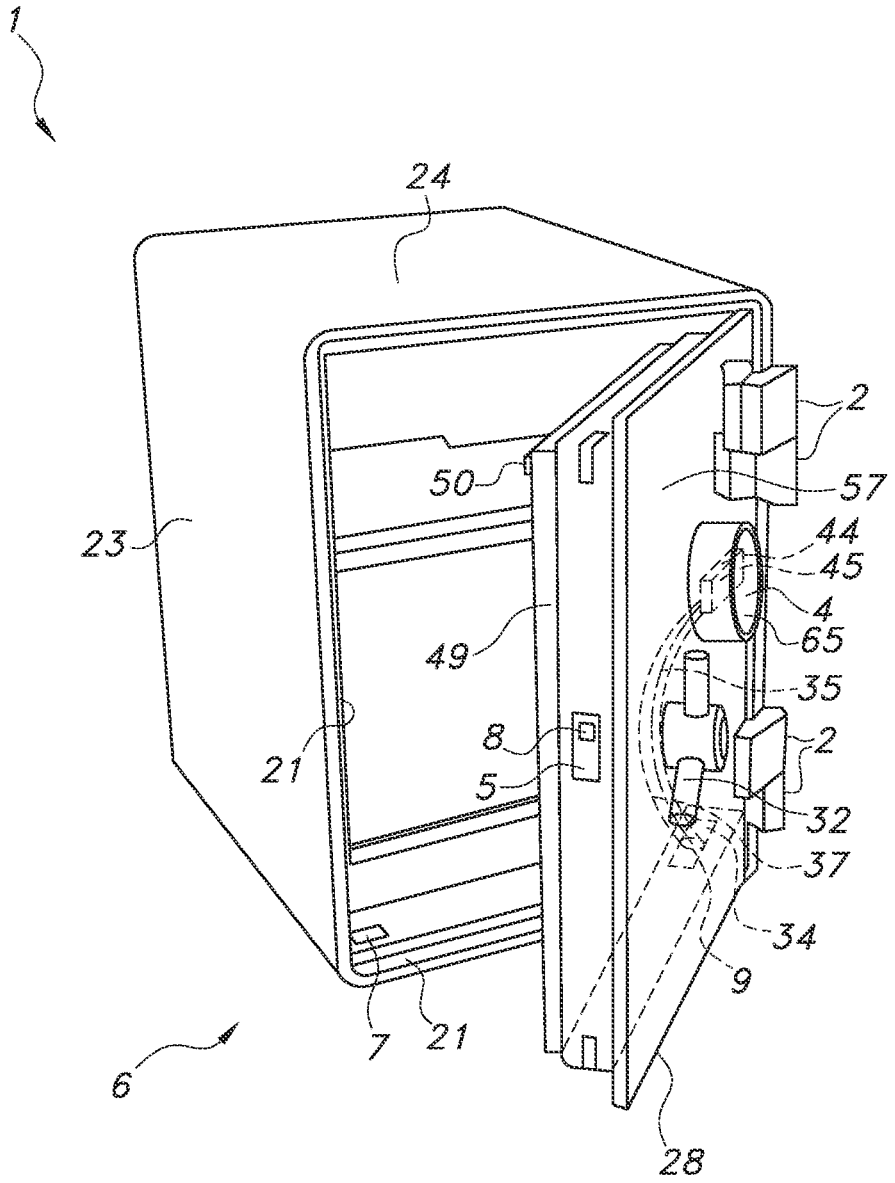
FIG. 1 is a perspective view of the security device for integration into a security system according to the present invention in an unlocked state with the safe door open.
Figure 2:
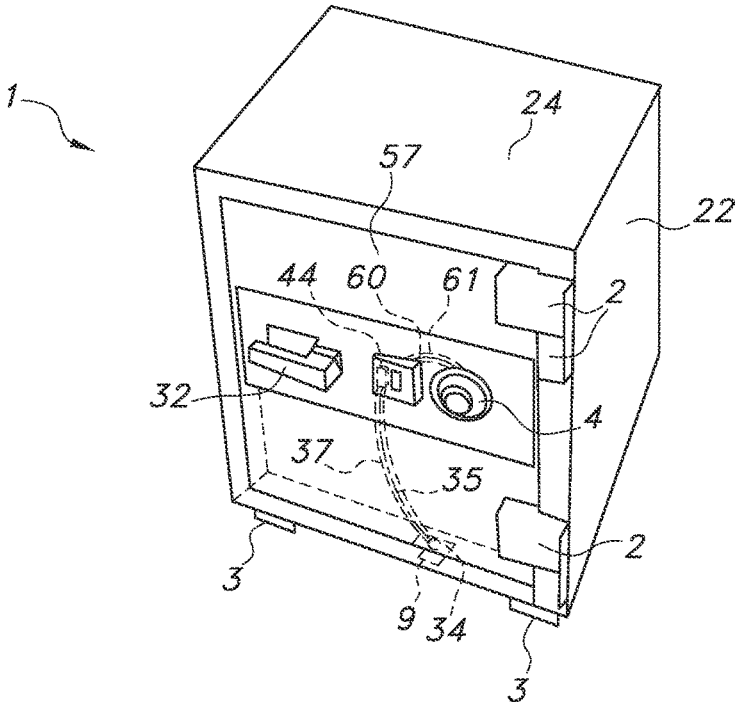
FIG. 2 is a perspective view of the security device for integration into a security system according to the present invention in a locked state with the door closed.

Referring to the drawings and particularly to FIGS. 1 through 2, one form of the invention is there shown. In the embodiment of the invention shown in the drawings, a storage container, such as a standard floor safe 1, comprises an enclosure having interconnected two sides, top, end, and bottom walls 22, 23, 24, 25, and 26 respectively. Safe 1 may also comprise a front wall 28, which further comprises one or more doors 57 movable between an open position, as shown in FIG. 1, and a closed position, as shown in FIG. 2. However, no particular shape of storage container or safe is required for the present invention, any shape of storage container being suitable.

FIG. 1 shows a side perspective view of safe 1 resting on the floor 6 with the safe lock 4 shown in an unlocked state. The safe lock 4 comprises a mechanism 5 of any type typically used in security safes, such as the illustrated type with a moveable locking bar 8, to selectively lock or unlock the door. The moveable locking bar 8 could be located along the edge of the safe door 57, as shown at locking bar 8, or at the corners of the safe door 57, as shown at locking bar 7. The user of the safe 1 generally locks and unlocks the door 57 using the lock face 65, which may comprise any suitable lock actuation means, shape, or design, such as a commonly available dial lock or electronic keypad lock, and handle 32. The internal linkage means of the lock face 65 to the safe lock mechanism 5 may be of varied configurations as will be appreciated by those skilled in the art. Since the details of construction and operation of such varied configurations of conventional safe lock mechanisms are not relevant to an understanding of the principles of this invention, they will not be detailed herein except to provide a general overview thereof and to the extent that an understanding of the mechanical locking portions thereof may be necessary. Such lock mechanism hardware structures are commonly found in numerous patents, the marketplace, and on most safes and can be directly examined if more detailed information thereon is desired.

Lock face 65 further comprises a base plate 27 behind the lock face 65, said base plate 27 further comprising one or more channels 36 abutting an outer face 51 of the exterior region of the safe 1. Channels 36 are sized to retain an antenna 38. The base plate 27 can be made of PVC, carbon fiber, or any other appropriate material. In one view, depicted in FIG. 3 without showing lock face 65 for illustrative purposes only, a bezel 39 is fixed adjacent to the base plate 27 such that the channels 36 and the antenna 38 housed within the channels 36 are hidden from sight, or at least partially obscured, behind the lock face 65. A retrofit kit of the present invention may comprise a device for adding one or more channels 36 or a selection of differently shaped bezels 39 to accommodate differently shaped lock faces or keypads. The antenna 38 is substantially, and preferably entirely, concealed within the channel 36 of the lock face 65 as opposed to mounting the antenna on the outer face 51 of the exterior region of the safe door 57 in plain view. Preferably, lock face 65, when viewed from any angle, does not readily reveal the embedded antenna 38, or, in another, less-preferred embodiment, substantially obscures a portion of the antenna 38.

Figure 4:
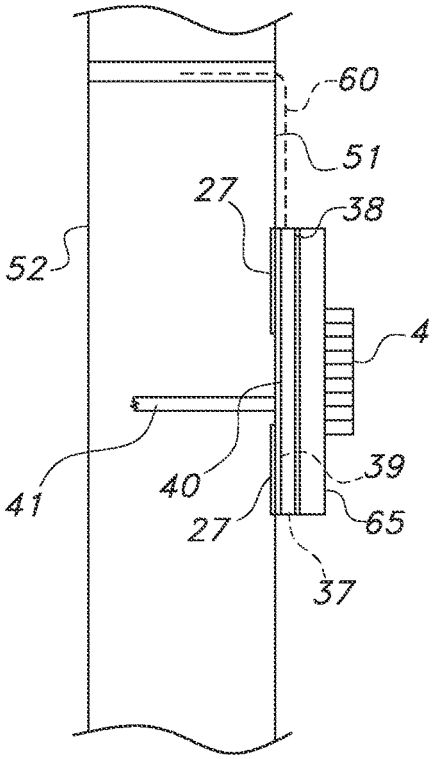
FIG. 4 is a detailed cross sectional side view of the lock and antenna, without a bezel, of the security device for integration into a security system, according to one embodiment of the present invention.
Figure 3:
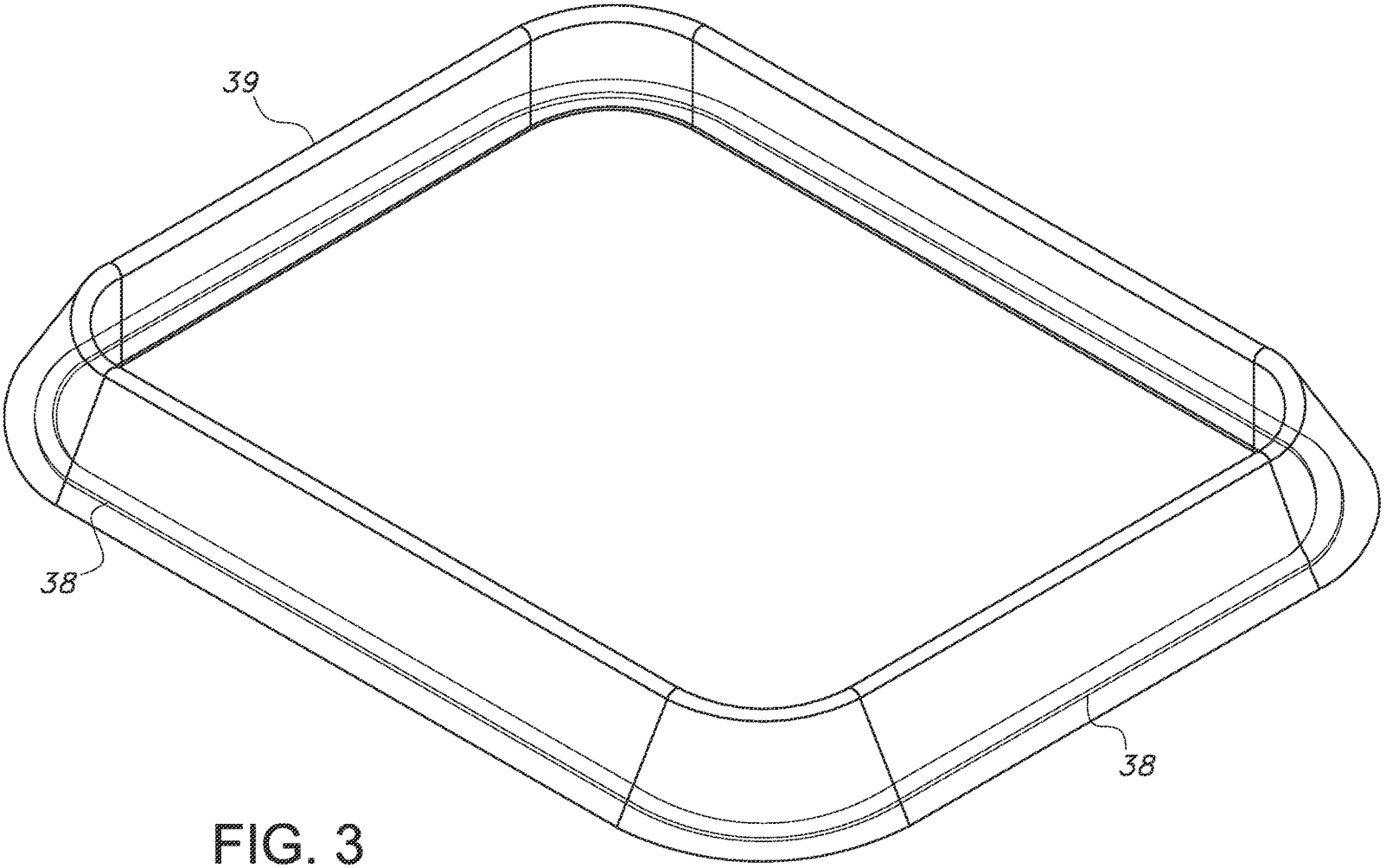
FIG. 3 is a perspective view of a bezel with part of the bezel broken away to illustrate the antenna within the channel formed by the bezel, according to one embodiment of the present invention.

FIGS. 3 and 4 show only one antenna 38 for illustrative purposes only. The present invention may be practiced using a plurality of antennae (not shown). The embedded antenna 38 need not be situated in the configuration shown in FIGS. 3 and 4 as multiple alternate configurations fall within the intended scope of the present invention. Antenna 38 can be positioned in straight or curved lines or any other configuration suitably accommodated by the shape of the lock face 65. Other antenna 38 orientations are within the scope of the invention. The invention is also not limited to the number or location of the antenna. Antenna 38 can be a radio frequency antenna for a home wireless system or any other type of antenna that can transmit communication signals wirelessly to a receiver, where the receiver can detect the incoming signals. Those skilled in the art will recognize that there may be a separate transmitting and receiving wires (not shown) within the antenna.

A safe manufactured with the security device already in place utilizes a wire entry or passage into the body of the safe, such as entry 40 through the outer face 51 of the safe door 57, which is typically already formed in many safes available commercially to allow for insertion of the lock wire 60 or another part of the lock mechanism 41 into the safe body. During the original installation of the lock 4, the lock wire 60 or another part of the lock mechanism 41 enters the interior region of the safe 1 for connection (not shown) with the lock mechanism 5. During installation as a retrofit, the illustrated embodiment of the invention is designed to make use of such an entry already in existence, so that the antenna 38 can be easily and conveniently mounted to the safe without the need for any aftermarket modification to the safe. If a particular safe did not have such an entry, such an entry could be drilled to allow installation.

As shown in FIG. 4, the antenna 38 is operatively connected through portal or entry 40, whether pre-existing or created through a retrofit process, to a transmitter 44 installed within the safe 1 and electrically connected to at least one antenna 38, preferably within a preexisting cavity 45 within the safe door 57 and accessible through a removable access panel 49 on the inner face 52 of the safe door 57, said access panel 49 attached to the safe door 57 by bolts 50 or other well-known securing means. Alternatively, if a safe was not made with a cavity into which the transmitter may be installed during retrofitting, the transmitter may be mounted within the interior region of the safe.

Figure 6:
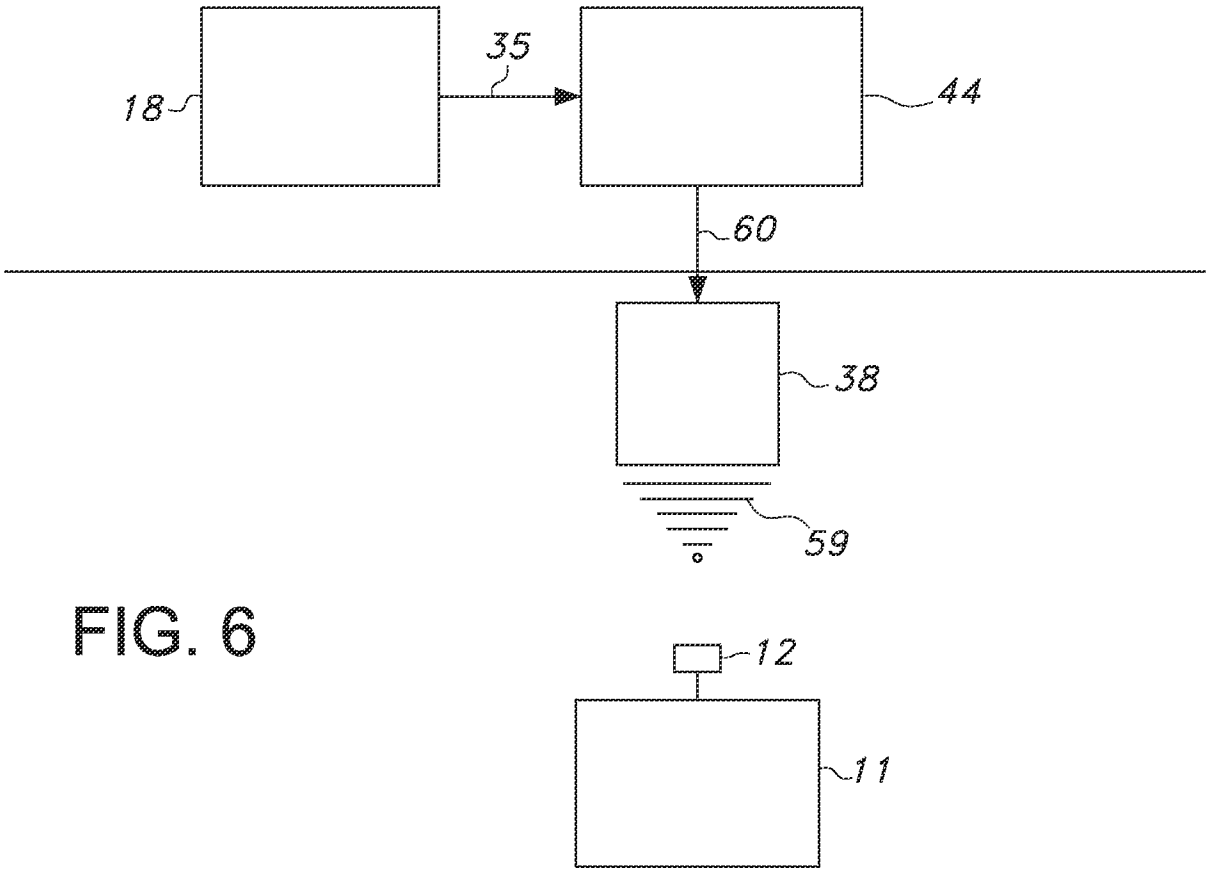
FIG. 6 is a system block diagram of a security device with alarm interface system showing the functional elements and their connections.

The security device 1 is wirelessly or communicatively connected via the transmitter and antenna (as represented in FIG. 6) to a security system 11 of a type similar to those commonly installed in residential and business establishments. The security system 11 includes or must be retrofit to include a standard transceiver 12 to communicate with the transmitter 44 of the safe 1. The transmitter 44 is of standard construction and is readily commercially available. The internal transmitter battery is optimally selected to last approximately five (5) years before requiring replacement and the security system can alert the owner of a low battery status. A suitable transmitter is distributed by Honeywell under the name and style 5800Micro Recessed Transmitter. The transmitter will optimally be selected to integrate with an existing security system. The manner of interconnection or integration of the security system transceiver 12 and the safe transmitter 44 within the system of the invention will presently be described.

Figure 5:
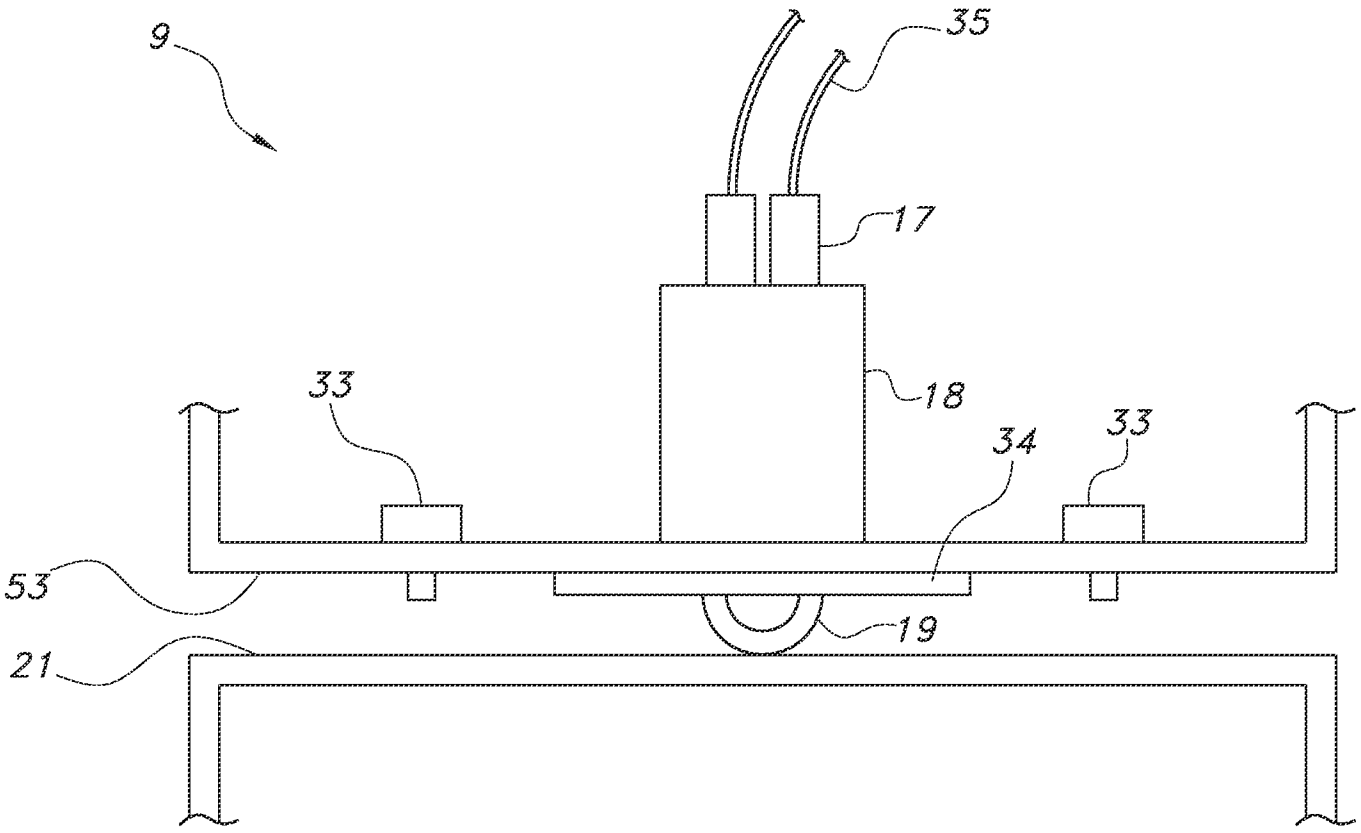
FIG. 5 is a detailed cross sectional side view of the switch mechanism of a preferred embodiment of the security device for integration into a security system of the present invention.

As shown in FIG. 5, a sensor, such as switch 18, is positioned in conjunction with an edge of the safe door 57, preferably in the lower edge 53 of the safe door 57 or inserted in a channel (not shown) in the locking bar 8 of the safe lock mechanism 5, so as to come into contact with the safe door frame 21. The switch 18 may be embodied by Short Roller Ball, Model No. DS-01 manufactured by George Risk Industries, Inc. or Recessed Switch Set with Magnasphere Technology, Model No. MS-2020-12 manufactured by George Risk Industries, Inc. Other suitable means for detecting the open/closed status of a door and generating a signal (not shown), including other forms of mechanical and magnetic switches, may be suitably employed in the present invention.

A detailed view of a preferred switch 18 is shown in FIG. 5 fixed to the lower edge 53 of the safe door 57 is the switch 18 having plunger 19.

The switch 18 abuts the safe door 57 such that when the safe door 57 is closed, the plunger 19 contacts safe frame 21 as shown in FIG. 5, actuating plunger 19. The switch 18 is held in a closed circuit position allowing current to flow to the transmitter 44 through a connection, such as a wire 35 within a channel 37, which triggers a signal 59 through a wire 60 embedded in a channel 61 or other connection from the transmitter 44 to the antenna 38 wherein a signal 59 is transferred to the security system 11. In one embodiment, when plunger 19 is actuated, a signal is sent from a switch relay 17. Receipt of the signal by the security system transceiver 12 will place the security system 11 in normal operating condition so that no alarm is activated. The security system 11 may be equipped with indicator lights or a screen showing the operative condition of the safe 1 and its various components.

In operation, as the safe door 57 begins to open and plunger 19 is taken out of contact with safe frame 21, plunger 19 is no longer actuated. When the plunger 19 is not actuated, the switch 18 is biased into the open circuit position allowing deactivation of transmitter 44. This will place the security system 11 in alarm mode so that an alarm is activated. It is anticipated that the circuit will normally be reset by closure of the door.

It can be appreciated that the specific components and electrical circuitry are meant to be exemplary of the manner in which the invention can be implemented. Other equivalent switching mechanisms can readily be employed. For example, the circuitry may be configured such that actuation of a sensor or switch completes an electrical circuit and generates an alarm rather than breaking a circuit.

The security system 11 may be configured so that, if the alarm system zone associated with the safe 1 has been manually deactivated through the security system 11 prior to opening the safe 1, the cessation of a signal 59 from the antenna 38 will not cause an alarm response from the security system 11. Thus, the safe 1 may function as a traditional safe or lockbox for authorized users. The features and controls of the safe 1 may be varied from embodiment to embodiment.

The functionality of the security device of the present invention discussed above with respect to the safe 1 of FIGS. 1 and 2 may be provided in combination with any type of sensor (such as, but not limited to, a motion sensor, altitude or level sensors, or recessed alarm contacts) installed, or removably connected to provide additional modes of detection, to any type of storage container including lockboxes, drawers, cabinets, safes, gun safes, bank safes, hinge-top boxes, compartments, containers, and the like, and any reference herein to any of these terms, including in the claims should be read expansively to include any such terms, unless specifically limited either explicitly or by a specific context. Thus, where actuation of the plunger 19 of the switch 18 and opening of the door 57 has been discussed previously, it should be understood to apply equally to any type of actuation and/or opening that provides access to contents of an otherwise locked compartment or container of any kind, as with the sliding of a drawer, opening of a hinged element or door, and the like.

Embodiments of the invention are intended for use with all types of security systems. Examples of security systems include whole-house security systems 11 such as that illustrated with respect to the discussion of FIG. 6, with or without a monitoring contract with a security company. Other examples include security systems wholly or partially incorporated into the safe 1, again with or without a monitoring contract with a security company. The security system, of whatever type it may be, may utilize wired, wireless, and/or mesh communication, may include or be a part of a home automation system.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A safe operative for communicating with an alarm system external to the safe, comprising:

a storage container comprising a door comprising an outer surface and an interior region of the safe;

a lock comprising:

a lock mechanism; and a lock face comprising a lock actuation component accessible from outside the safe and an outer perimeter, wherein a user unlocks the door using the lock face;

a sensor located inside the safe operative for generating a signal;

a transmitter located inside the safe operatively connected to the sensor for communicating the signal;

an alarm antenna operatively connected to the transmitter for wirelessly communicating the signal to the alarm system located outside the safe;

wherein the alarm antenna is positioned outside the outer surface of the door in one of:

a dial indicator of the lock face, wherein the antenna does not extend beyond the dial indicator of the lock face, a base plate located behind the lock face, wherein an outer perimeter of the base plate does not extend beyond the outer perimeter of the lock face or wherein the outer perimeter of the base plate does not extend beyond the dial indicator, or a bezel located behind the lock face, wherein an outer perimeter of the bezel does not extend beyond the outer perimeter of the lock face or wherein the outer perimeter of the bezel does not extend beyond the dial indicator.

2. The safe of claim 1, wherein the antenna is positioned in the base plate located behind the lock face, wherein the outer perimeter of the base plate does not extend beyond the outer perimeter of the lock face.

3. The safe of claim 1, wherein the antenna is positioned in a channel of the lock face.

4. The safe of claim 1, wherein the antenna is positioned in the bezel located behind the lock face, wherein the outer perimeter of the bezel does not extend beyond the outer perimeter of the lock face.

5. The safe of claim 1, further comprising a lock element extending from the lock into the interior region of the safe, wherein the antenna forms an antenna loop with the lock element extending through the antenna loop.

6. The safe of claim 5, wherein the lock element comprises a mechanism of the lock or a wire extending from the lock through the door of the safe.

7. An alarm antenna for a safe comprising a storage container comprising a door having an outer surface, an interior region of the safe, a lock attached to the door comprising a lock mechanism and a lock face comprising a lock actuation component accessible from outside the safe and an outer perimeter, wherein a user unlocks the door using the lock face, a sensor located inside the safe operative for generating a signal, and a transmitter located inside the safe operatively connected to the sensor for communicating the signal, the alarm antenna comprising:

the alarm antenna configured for connection to the transmitter for wirelessly transmitting the signal from the transmitter to an alarm system located outside the safe;

wherein the alarm antenna is positioned outside the outer surface of the door in one of:

a dial indicator of the lock face, wherein the antenna does not extend beyond the dial indicator of the lock face, a base plate located behind the lock face, wherein an outer perimeter of the base plate does not extend beyond the outer perimeter of the lock face or wherein the outer perimeter of the base plate does not extend beyond the dial indicator, or a bezel located behind the lock face, wherein an outer perimeter of the bezel does not extend beyond the outer perimeter of the lock face or wherein the outer perimeter of the bezel does not extend beyond the dial indicator.

8. The alarm antenna of claim 7, wherein the antenna is positioned in the base plate located behind the lock face, wherein the outer perimeter of the base plate does not extend beyond the outer perimeter of the lock face.

9. The alarm antenna of claim 7, wherein the antenna is positioned in a channel of the lock face.

10. The alarm antenna of claim 7, wherein the antenna is positioned in the bezel located behind the lock face, wherein the outer perimeter of the bezel does not extend beyond the outer perimeter of the lock face.

11. The alarm antenna of claim 7, wherein the lock further comprises a lock element extending from the lock into the interior region of the safe, and wherein the antenna is configured to form an antenna loop with the lock element extending through the antenna loop.

12. The alarm antenna of claim 11, wherein the lock element comprises a mechanism of the lock or a wire configured to extend from the lock through the door of the safe.

13. An alarm retrofit kit for a safe having a door with an outer surface, an interior region of the safe, and a lock comprising a lock mechanism and a lock face comprising a lock actuation component accessible from outside the safe and an outer perimeter, wherein a user unlocks the door using the lock face, the alarm retrofit kit comprising:

a sensor component of the alarm retrofit kit configured to be positioned inside the safe operative for generating a signal;

a transmitter component of the alarm retrofit kit configured to be positioned inside the safe further configured to be operatively connected to the sensor, the transmitter operative for communicating the signal;

an alarm antenna component of the alarm retrofit kit configured to be positioned outside the outer surface of the door in one of:

a dial indicator of the lock face, wherein the antenna does not extend beyond the dial indicator of the lock face, a base plate located behind the lock face, wherein an outer perimeter of the base plate does not extend beyond the outer perimeter of the lock face or wherein the outer perimeter of the base plate does not extend beyond the dial indicator, or a bezel located behind the lock face, wherein an outer perimeter of the bezel does not extend beyond the outer perimeter of the lock face or wherein the outer perimeter of the bezel does not extend beyond the dial indicator, the alarm antenna component further configured for connection to the transmitter, the alarm antenna operative for wirelessly transmitting the signal from the transmitter to an alarm system located outside the safe.

14. The alarm retrofit kit of claim 13, wherein the antenna is positioned in the base plate configured to be located behind the lock face, wherein the outer perimeter of the base plate does not extend beyond the outer perimeter of the lock face.

15. The alarm retrofit kit of claim 13, wherein the antenna is positioned in a channel of the lock face.

16. The alarm retrofit kit of claim 13, wherein the antenna is positioned in the bezel configured to be located behind the lock face, wherein the outer perimeter of the bezel does not extend beyond the outer perimeter of the lock face.

17. The alarm retrofit kit of claim 13, wherein the lock further comprises a lock element extending from the lock into the interior region of the safe, and wherein the antenna is configured to form an antenna loop with the lock element extending through the antenna loop.

18. The alarm retrofit kit of claim 17, wherein the lock element comprises a mechanism of the lock or a wire extending from the lock through the door of the safe.

* * * * *